United States Patent [19]

Kawasaki

[11] Patent Number: 4,913,071

[45] Date of Patent: Apr. 3, 1990

[54] AUTOMATIC FEEDING DEVICE FOR SEWING MACHINE HAVING A CYLINDER, AN ARM RECIPROCATED BY THE CYLINDER AND A FEEDER CONNECTED TO THE ARM

[75] Inventor: Kiyoshi Kawasaki, Akishima, Japan

[73] Assignee: Tachi-S Co., Ltd., Akishima, Japan

[21] Appl. No.: 295,797

[22] Filed: Jan. 11, 1989

[30] Foreign Application Priority Data

May 31, 1988 [JP] Japan ..... 63-72098[U]

[51] Int. Cl.[4] ..... D05B 27/00; D05B 33/02

[52] U.S. Cl. ..... 112/152; 112/153

[58] Field of Search ..... 112/152, 153, 121.12, 112/121.15, 121.26, 121.27, 306, 307

[56] References Cited

U.S. PATENT DOCUMENTS

| | | | |
|---|---|---|---|
| 4,037,547 | 7/1977 | Marforio | 112/152 X |
| 4,471,706 | 9/1984 | Hubele et al. | 112/272 |
| 4,527,491 | 7/1985 | Block et al. | 112/152 X |

*Primary Examiner*—Andrew M. Falik

*Attorney, Agent, or Firm*—Browdy & Neimark

[57] ABSTRACT

An automatic feeding device for a sewing machine, comprising an arm, a cylinder fixed to one end of the arm, and a feeder provided on the other end of the arm. A base cloth is inserted into the feeder and transferred by the cylinder to an operative point adjacent the sewing machine, and further transferable back to a non-operative point away from the sewing machine, in an automatic way. The base cloth is retained and prevented against reverse movement within the feeder which includes a plurality of stopper pins, and forward and rearward retaining members.

8 Claims, 4 Drawing Sheets

AUTOMATIC FEEDING DEVICE FOR SEWING MACHINE HAVING A CYLINDER, AN ARM RECIPROCATED BY THE CYLINDER AND A FEEDER CONNECTED TO THE ARM

BACKGROUND OF THE INVENTION

1. Field of the Invention

The present invention relates to an automatic feeding device for use with a sewing machine, which is adapted to feed a base cloth to a sewing position adjacent to the sewing machine, and in particular, relates to a device for automatically feeding a base cloth of anchor cloth to a sewing position on the table of the sewing machine, permitting the sewing of the base cloth to the rear surface of a trim cover assembly, and thus produce an anchor cloth thereon for pulling and anchoring the trim cover assembly so as to manufacture an automotive seat.

2. Description of the Prior Art

In the past, a base cloth of anchor cloth, which is adapted for pulling inward and anchoring a trim cover assembly to a cushion member to secure the former to the latter, has been sewn by a normal stitching method to the trim cover assembly in order to provide the anchor cloth on the trim cover assembly. The hitherto stitching method for that purpose involves first securing a suitably cut base cloth on the table of a sewing machine by means of a securing means, then placing a central seating portion of the trim cover assembly over thus-secured base cloth, then securing the same to the table by means of a clamp, thereafter, stitching the base cloth to the rear side of the trim cover assembly through the operation of the sewing machine.

Such stitching method has been found defective in that the seam appears on the outer surface of the trim cover assembly, because the stitching straight needle of the sewing machine is penetrated vertically through both base cloth and trim cover assembly, which has left a problem in impairing the outer aesthetic appearance of automotive seats. Additionally, the seam on the trim cover assembly is always exposed for contact with the body of an occupant on the seat and very prone to wearing or tearing, thus resulting in the great likelihood of the anchor cloth being separated from the trim cover assembly.

A blind stitching method is thought to give a technical breakthrough to the above-stated problem, according to which it is anticipated that the base cloth can be sewn to the lower most layer and intermediate padding layer of the trim cover assembly by use of a hook-like blind stitching needle through the blind stitching operation of the sewing machine, so that the seam does not appear on the upper surface of the trim cover assembly.

However, practically, such a blind stitching method entails the step of placing the base cloth on the the rear side of turned-inside-out trim cover assembly, and in view of the soft, thin nature of the base cloth, effecting the blind stitch for both base cloth and trim cover assembly results in the undesired dislocation of the base cloth relative to the trim cover assembly and thus the poor sewing state of the former to the latter.

Consequently, the meritorious aspect of the blind stitching has been a target for providing seamless sewing of the anchor cloth to the trim cover assembly, and no good answer has yet been presented.

SUMMARY OF THE INVENTION

With the above-stated problem in view, it is a purpose of the present invention to provide a novel automatic feeding device for a sewing machine, which permits a blind stitching of a base cloth to a trim cover assembly.

In accomplishment of the purpose, the present invention comprises a cylinder fixed on a table of the sewing machine, an arm, having a base end is connected to the cylinder, such that the arm is movable towards and away from the sewing area of the sewing machine through operation of the cylinder, and a feeder fixed at the free end of the arm, the feeder being so adapted that the base cloth is slidably inserted therethrough and composed essentially of a clearance through which the base cloth passes freely, a forward retaining plate section, a rearward retaining plate section, and a plurality of stopper pins fixed within the feeder, the stopper pins being oriented in a direction wherein the base cloth is to be fed for sewing. In the present invention, the base cloth used is of a long strip type.

Accordingly, in operation, a trim cover assembly is first turned inside out and placed on the table of the sewing machine, the base cloth is inserted into the feeder, with the end of the base cloth being projected from the feeder, then, by actuating the cylinder, the feeder is transferred to an operative point in close proximity of the sewing area of the sewing machine. Thereafter, the base cloth is subjected to a blind stitching by means of the sewing machine, after completion of the sewing, the non-sewn remainder of the base cloth is cut from the sewn one by use of a scissors or the like, and the feeder is transferred away from the sewing machine to a non-operative point by operation of the cylinder.

It is therefore appreciated that the base cloth is prevented by the stopper pins of the feeder against back movement, assuring one-way, non-reversing feeding of the base cloth for the blind stitching, and that the soft base cloth is guided by the feeder to be precisely sewn to the trim cover assembly. Further, during the forward-and-backward movement of the feeder, the base cloth is positively retained by the forward and backward retaining plate sections of the feeder, which ensures that the base cloth is kept in a condition ready for sewing, regardless of the feeder's movement. Accordingly, the base cloth is smoothly fed towards the sewing machine and sewn to the trim cover assembly without any dislocation, so that the resultant anchor cloth is produced on the trim cover assembly without the above-mentioned problem inherent in the blind stitching method.

DETAILED DESCRIPTION OF PREFERRED EMBODIMENTS OF THE INVENTION

Figure 1:
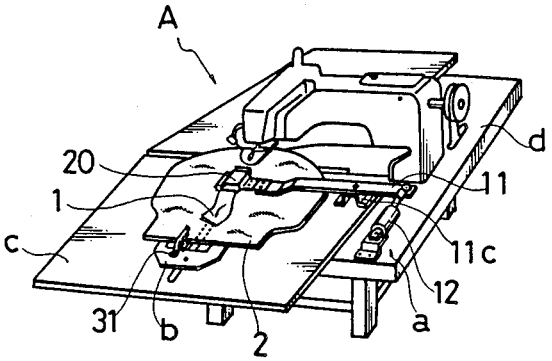
FIG. 1 is a perspective view of a sewing machine which is provided with is an automatic feeding device in accordance with the present invention.

In FIG. 1 the automatic feeding sewing machine (A), is provided with an automatic feeding device (a) of the present invention to be described hereinafter.

Figure 2:
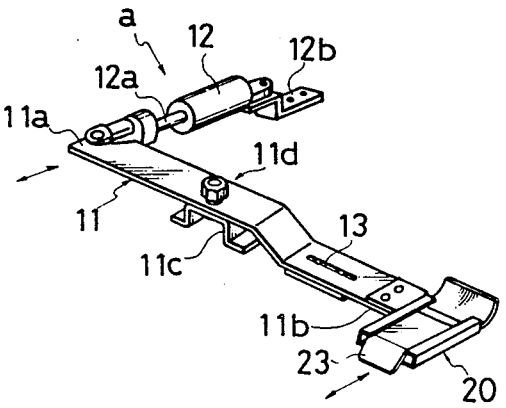
FIG. 2 is a perspective view of principal parts of the present invention.

As best shown in FIG. 2, the automatically feeding device (a) is mounted on the platform (d) of the sewing machine (A), comprising an arm (11), a cylinder (12) supported via a bracket (12*b*) on the platform (d), the cylinder (12) being at its movable rod (12*a*) connected to the base end part (11*a*) of the arm (11), and a feeder (20) fixedly provided on the free end part (11*b*) of the arm (11).

A slider member (11*c*) is arranged on the arm (11) such that it is fixed on the rear surface of the arm (11) by means of bolt (11*d*) at the point in the vicinity of the base end part (11*a*) of the arm (11). The slider member (11*c*) is slidable on the table (c) so that the arm (11) is supported by the slide member (11*c*) and movable in parallel with the table (c) by the cylinder (12), thereby bringing the feeder (20) with a good stability towards the sewing machine (A).

Figure 11:
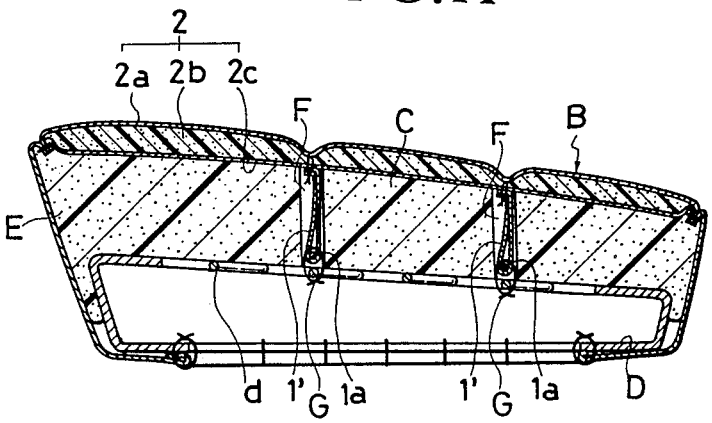
FIG. 11 is a sectional view showing that the resultant product formed by the invention is affixed to a cushion member.

Designation (2) denotes a seating central portion (2) of a trim cover assembly which is to be affixed over the corresponding part of a cushion member (E) (See FIG. 11).

Figure 10:
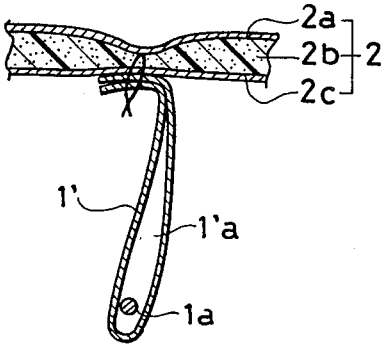
FIG. 10 is a sectional view taken along the line X—X in the FIG. 9.

Designation (1) refers to a long strip of folded soft base cloth (formed from cotton or non-woven fabric) usually used for forming an anchor cloth (1') as shown in FIG. 10, the soft base cloth (1) having been cut into a predetermined dimensions of belt-like strip and folded together in its longitudinal direction. The anchor cloth (1') serves to pull the central seating portion (2) inwardly of the cushion member (E) and anchor it to a wire (1*a*) extended within the cushion member (E), so that the trim cover assembly is securely attached over the cushion member (E).

The central seating portion (2) of the trim cover assembly is retained at its one edge on the sewing table (c) by means of a clamp (31) of a plate-like retaining member (b) which is movable in a direction towards and away from the sewing machine (A), as will be explained later.

As shown, the base cloth (1) is inserted through the feeder (20), and the operation of the cylinder (12) causes the rod (12*a*) of the cylinder to retract or extend, thereby transferring the arm (11) towards the sewing machine (A) to bring the free end of the base cloth (1) to a sewing position in close proximity of the needle (5) of the sewing machine (A) (See FIG. 5), or transferring the arm (11) away from the sewing machine (A) to bring the base cloth (1) to a non-operation position indicated by the phantom line in FIG. 1.

Numeral (13) denotes an extension adjustment portion, by means of which the arm (11) may be adjusted in length so that the base cloth (1) may be fed exactly to the sewing machine (A), regardless of sewing points.

Figure 3:
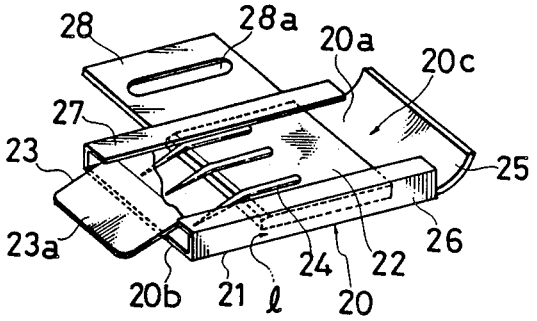
FIG. 3 is a partially broken perspective of a feeder of the present invention.

FIG. 3 depicts the feeder (20) as comprising a base wall (21), a pair of inwardly curved lateral flanges (26)(27) which are fixedly provided on the opposite sides of the base wall (21) in a mutually faced relationship, thus forming a hollow body (20*c*), an upper plate member (23) fixed at the upper portion of the hollow body (20*c*), the upper plate member (23) having a downwardly inclined forward edge which constitutes a forward retaining member (23*a*) extending forwardly from the upper plate member (23) in an integral manner, and an upwardly curved rearward retaining member (25) which extends rearwardly from the base wall (21) in an integral manner. Designations (20*a*)(20*b*), respectively, denote an entrance opening of the feeder (20) into which the base cloth (1) is fed, and an exit opening of the same feeder (20) from which the base cloth (1) is advanced towards the sewing machine (A).

Figure 4:
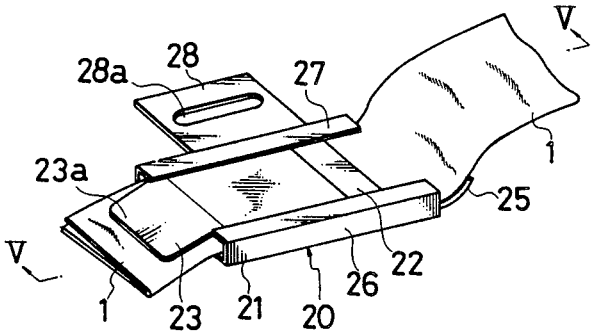
FIG. 4 is a perspective view of the feeder, showing the state wherein a base cloth is inserted therein.
Figure 5:
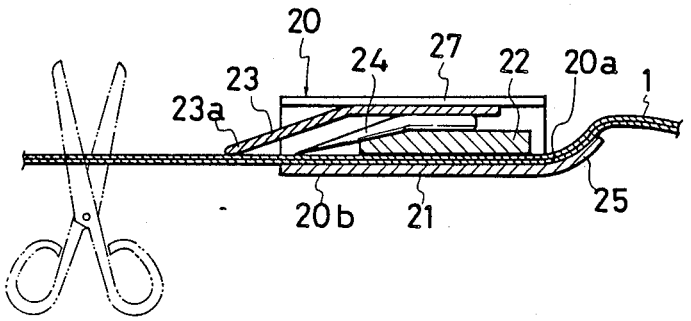
FIG. 5 is a sectional view taken along the line V—V in the FIG. 4.

Within the feeder (20), an intermediate plate (22) is provided such that it is interposed between and in parallel with the upper plate member (23) and base wall (21), with a clearance (l) between the intermediate plate (22) and base wall (21). The clearance (l) should be sufficient to allow the base cloth (12) to pass therethrough freely, as seen in FIGS. 4 and 5. Between the intermediate plate (22) and upper plate member (23), a plurality of stopper pins (24) are so arranged that they are fixed on the intermediate plate (22) in an equidistant relationship with one another and their respective pointed ends extend from the forward end of the intermediate plate (22) in a downwardly inclined manner. It is preferable that those pointed ends of the stopper pins (24) are located flush with the rear surface of the intermediate plate (22), or located slightly therebelow, and that, further, they are disposed within the body (20*c*), not extending externally thereof.

FIGS. 4 and 5 shows the state wherein the base cloth (1) is inserted through the feeder (20). As shown, the base cloth (1), which is folded together in its longitudinal direction, is caused to move through the feeder (20) in the arrow direction for blind stitching, as will be described later.

Although not shown, the base cloth (1) is a long strip which is wound about a rotation body and is supplied therefrom into the feeder (20) for sewing on the rear surface of the central seating portion (2) associated with the trim cover assembly.

Figure 6:
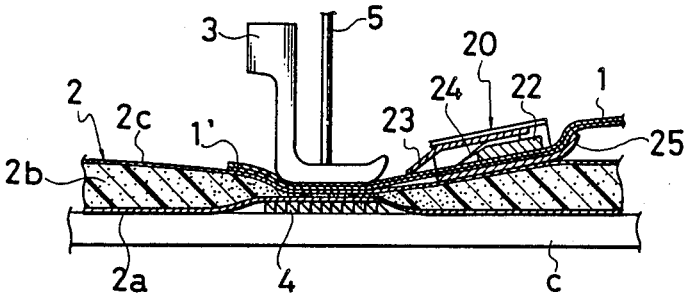
FIG. 6 is a section view which shows that the base cloth is sewn to a trim cover assembly.

As shown in FIG. 6, the base cloth (1), which is inserted in the feeder (20), is subjected to blind stitching by means of the sewing machine (A) which uses a blind stitching needle (5) of hook-like shape (not show in detail). Specifically, in the practical sewing operation, the blind stitching is effected to the opened side of the base cloth (1) so that the remaining portion of the base cloth (1) opposite to such opened side may form a loop shape in section (as best understandable from FIG. 10). Therefore, the opened side of base cloth (1) is sewn together in its longitudinal direction at a predetermined length by means of the hook-like blind stitching needle (5) so as to provide the anchor cloth (1'). Numerals (3) and (4) denote, respectively, a pressing retainer and a feed dog member associated with the sewing machine (A).

The central seating portion (2) comprises a top covering layer (2*a*), a foam wadding (2*b*) (preferably formed from a slab material of urethane foam), and a back cloth (2*c*) (preferably formed of a non-woven fabric). The base cloth (1) is sewn to the back cloth (2*c*) and the foam wadding (2*b*) by way of blind stitching so that any seam does not appear the surface of the top cover layer (2*a*).

Figure 7:
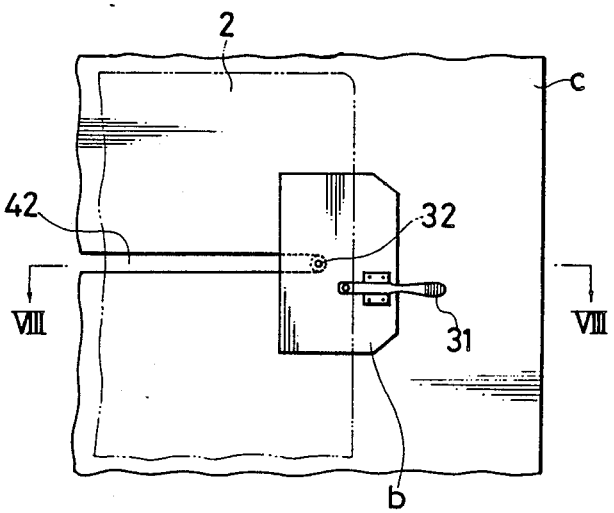
FIG. 7 is a partially broken perspective view of a table of sewing machine.
Figure 8:
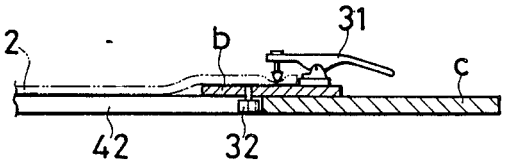
FIG. 8 is a sectional view taken along the line VIII—VIII in the FIG. 7.

Referring to FIGS. 7 and 8, the central seating portion (2) is at its one edge portion secured on the table (c) by means of the clamp (31) provided on the retaining member (b) which has a roller (32) rotatably fixed generally at its central part, the roller (32) being slidably fitted in a guide slit (42) formed in the table (c). The guide slit (42) extends rectilinearly in the direction wherein both base cloth (1) and central seating portion (2) are to be sewn by the sewing machine (A). Thus, during the sewing operation, due to the movement of the central seating portion (2) by virtue of the sewing feeding effect of the sewing machine (A), the retaining member (b) is caused to move together with the central seating portion (2) along the guide slit (42).

Figure 9:
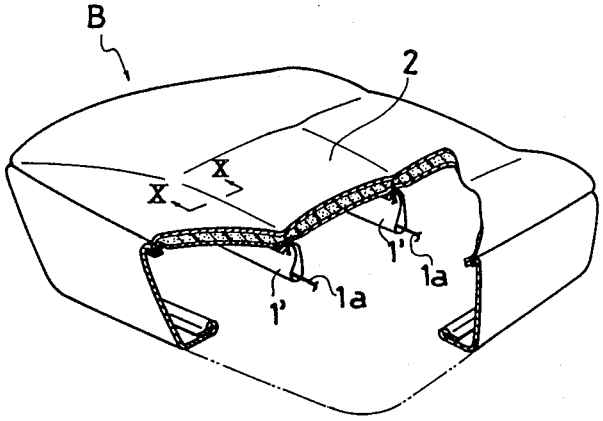
FIG. 9 is a partially cutaway perspective view of a resultant trim cover assembly formed by the invention.

FIGS. 9 and 10 illustrate the state wherein the base cloth (1) is sewn to the rear side of the central seating portion (2) of trim cover assembly (B), whereupon a loop-like anchor cloth (1') is produced dependent from the rear surface of the central seating portion (2). As illustrated, a wire member (1*a*) is inserted within the hollow portion (1*a*') of the anchor cloth (1'). Hence, as can be understood from FIG. 11, the trim cover assembly (B) including the central seating portion (2) is affixed over the cushion member (E) at a seat assembling process, and it is observed that the wire member (1*a*) inserted in the anchor cloth (1') is secured via a hog ring (G) to a spring (d) extended within a frame (D), and that the anchor cloth (1') extends downwardly through the aperture (F) formed in the cushion member (E). From FIGS. 9, 10 and 11, it is noted that the anchor cloth (1'), wire member (1*a*), aperture (F) and hog ring (G) are two in number, but they may be provided in additional numbers as desired.

Now, a description will be made of the operation of the present invention,, hereinafter.

At first, the central seating portion (2) associated with the trim cover assembly (B), which is previously cut into a predetermined shape, is placed on the table (c), and the one end of the central seating portion (2) is secured on the table (c) by means of the clamp (31). Meanwhile, the forward end portion of the base cloth (1) is inserted into the feeder (20) so that the extremity of such forward end portion is projected at about 15 mm out of the forward retaining member (23*a*) of the feeder (20) in order that the forward end portion of the base cloth (1) is pressingly retained by the pressing retainer (3) of the sewing machine (A) against the central seating portion (2) at the beginning of the sewing operation. Next, by actuating the cylinder (12), the feeder (20) with the base cloth (1) inserted therein is transferred to an operative point (as seen by the solid line in FIG. 1) in the close proximity of the pressing retainer (3) of the sewing machine (A), and then, the projected extremity of the base cloth (1) is pressed and retained by the retainer (3) against a predetermined area of the central seating portion (2) as in FIG. 6. At this stage, care should be taken to ascertain that the opened side of the base cloth (1) is placed in the sewing path for sewing by the needle (5), so as to form the base cloth (1) into such a loop shape in section as shown in FIG. 10. Then, the sewing machine (A) is switched on to start the blind stitching so as to sew the opened side of the base cloth (1) to the back cloth (2*c*) and wadding (2*b*) of the central seating portion (2) in cooperation with the feeding action of both pressing retainer (3) and feed dog member (4) of the sewing machine (A). After completion of that blind stitching operation at a predetermined length, the base cloth (1) is cut away from the resultant anchor cloth (1') by means of a scissors or the like. Thereafter, the feeder (20) is transferred backwardly to a non-operative point (as seen by the phantom line in FIG. 1) by operation of the cylinder (12). Subsequent to this one round of sewing operation, another central seating portion of trim cover assembly is placed and secured on the table (c) by the clamp (31), and the feeder (20) is again transferred to the operative point. The same steps as described above are executed for blind stitching operation against both the new central seating portion and the base cloth. This subsequent sewing operation is automatically effected when the feeder (20) is transferred back to the non-operative point, actuating a switch means (not shown) which is for starting the operation of cylinder (12) to transfer the feeder (20) again to the operative point.

It is, further, to be understood that the base cloth (1) is retained unmoved within the feeder (20) even while the latter is being transferred, by virtue of the forward retaining member (23) and reaward retaining member (25), respectively, functioning to bend the forward end portion of the base cloth (1) downwardly, and bend the rear portion of the base cloth (1) upwardly, thereby curving the base cloth (1) in a "⟋⟍" shaped configuration in section within the feeder (20), as in FIG. 5.

While the present invention has been described for sewing the base cloth (1) to the trim cover assembly (E), it should be understood that, instead thereof, a welt, a welt core member, a strip of leather or the like can be sewn to the trim cover assembly (E) or other base material by the blind stitching method, using the automatic feeding device (a) in accordance with the present invention, and that the illustrated embodiment is not a limited one of the present invention, but other modifications, replacements, and additions may structurally be possible without departing from the spirit and scope of the appended claims for the invention.

With the above-described structure, the present invention is endowed with the following advantageous effects.

(1) The base cloth (1) is prevented against reverse movement within the feeder (20) by means of the stopper pins (24) whose pointed end is oriented in the direction wherein the base cloth (1) is to be fed for sewing.

(2) While the feeder (20) is being transferred by the cylinder (12), the base cloth (1) is positively kept unmoved within the feeder (20) with the forward end part of the base cloth (1) being projected from the feeder (20) by virtue of the forward and rearward retaining members (23)(25) cooperatively functioning to curve the base cloth (1) in such "⟋⟍" shaped configuration in section within the feeder (20).

(3) The soft base cloth (1) can be fed without its distortion and subjected to blind stitching in a smooth way.

Accordingly, the base cloth (1) is smoothly fed towards the sewing machine (A) and sewn to the trim cover assembly (B) without such dislocation and poor sewing problems as discussed previously regarding the blind stitching operation using the hook-like needle. This permits automatic sewing of the base cloth (1) to a great number of trim cover assemblies with seamless appearance, more efficiently and rapidly, and thus paves the way for producing many seats without undesired seam via the blind stitching method.

What is clamed is:

1. An automatic feeding device for use in a sewing machine, comprising:

a cylinder fixed on a table of the sewing machine;

an arm having a base end part connected to said cylinder so that said arm is movable towards and away from a sewing portion of the sewing machine by means of said cylinder causing automatic feeding of a base cloth; and a feeder provided at a free end part of said arm, said feeder being so adapted that the base cloth is inserted therethrough and including:

(a) a clearance defined in said feeder, said clearance being of a dimensions sufficient for said base cloth to pass therethrough;

(b) a forward retaining means provided at a forward end of said feeder; said forward retaining means being adapted to bend and retain said base cloth;

(c) a rearward retaining means provided at a rearward end of said feeder opposite the forward end; said rearward retaining means being adapted to bend and retain said base cloth; and (d) a plurality of stopper pins provided within said feeder such that they are disposed between said forward and rearward retaining means and oriented in a direction wherein said base cloth is fed for sewing by said sewing machine; and wherein said base cloth is prevented against reverse movement and retained unmoved within said feeder while said feeder is being transferred by means of said cylinder.

2. The device according to claim 1, wherein said device further includes a guide slit formed in said table of said sewing machine and a retaining member movably mounted on said table such that it is slidably fitted in said guide slit, and wherein said retaining means has a clamp provided thereon and is adapted to retain thereon a base cloth material by means of said clamp, whereby said base cloth is sewn to said cloth material when said sewing machine is operated.

3. The device according to claim 2, wherein said base cloth material comprises a trim cover assembly for an automotive seat.

4. The device according to claim 1, wherein said sewing machine is provided with a needle adapted for blind stitching.

5. The device according to claim 1, wherein said feeder comprises a flat base wall, a pair of inwardly curved lateral flanges each being formed at respective lateral ends of said flat base wall, an entrance opening defined at the forward end of said feeder, an exit opening defined at the rearward end of said feeder, wherein said base cloth is fed into said entrance opening and out of said exit opening, wherein said forward retaining means is provided at said entrance opening in a manner projecting therefrom and said rearward retaining means is proved at said exit opening in a manner projecting therefrom, wherein said forward retaining means is bent downwardly and said rearward retaining means is curved upwardly, and wherein an intermediate plate member is provided within said feeder in parallel with said base wall, thereby defining a passageway through which said base cloth is passed freely, and said plurality of stopper pins are fixed upon said intermediate plate member.

6. The device according to claim 1, wherein said arm is provided with a slider member at its rear surface, said slider member is slidable on said table of said sewing machine, such that said arm is moved in parallel with said table by operation of said cylinder.

7. The device according to claim 1, wherein said base cloth comprises a long strip of folded base cloth folded together in its longitudinal direction and wherein said device further comprises means for feeding said base cloth through said feeder for sewing by said sewing machine such that an opened side of said base cloth is sewn by said sewing machine.

8. The device according to claim 1, further comprising means for feeding said base cloth so as to be sewn by said sewing machine to a rear surface of a trim cover assembly so as to be sewn thereon into an anchor cloth of a loop-like configuration in section.

* * * * *